US008286264B2

(12) United States Patent
Hull

(10) Patent No.: US 8,286,264 B2
(45) **Date of Patent: *Oct. 16, 2012**

(54) AMBIDEXTROUS GLOVE

(75) Inventor: James L. Hull, Malvern, OH (US)

(73) Assignee: Summit Glove Inc., Minerva, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/237,283

(22) Filed: Sep. 20, 2011

(65) Prior Publication Data

US 2012/0005807 A1 Jan. 12, 2012

Related U.S. Application Data

(63) Continuation of application No. 12/421,785, filed on Apr. 10, 2009, now Pat. No. 8,028,348.

(51) Int. Cl.
*A41D 19/00* (2006.01)

(52) U.S. Cl. ..... 2/163; 2/159

(58) Field of Classification Search ..... 2/161.6, 2/167, 16, 164, 168, 18, 19, 169, 163, 159, 2/158; 66/174, 172 E See application file for complete search history.

(56) References Cited

U.S. PATENT DOCUMENTS

| | | | |
|---|---|---|---|
| 2,380,633 | A | 7/1945 | Daiber |
| 3,883,898 | A | 5/1975 | Byrnes, Sr. |
| 4,115,873 | A | 9/1978 | Stansbury |
| 4,534,066 | A | 8/1985 | Hansson |
| 4,750,218 | A | 6/1988 | Ziegler |
| 4,752,973 | A | 6/1988 | Wolfberg et al. |
| 4,809,365 | A | 3/1989 | Chen et al. |
| 4,860,385 | A | 8/1989 | Zidele |
| 5,054,126 | A | 10/1991 | Rivkin |
| 5,799,333 | A | 9/1998 | McGarry et al. |
| 5,829,089 | A | 11/1998 | Steadman |
| 5,833,911 | A | 11/1998 | Llort et al. |
| 5,848,440 | A | 12/1998 | Pajarola |
| 5,971,240 | A | 10/1999 | Dequaine |
| 6,029,275 | A | 2/2000 | Deprado |
| 6,289,515 | B1 | 9/2001 | Fous |
| 7,062,792 | B2 | 6/2006 | Jaunault et al. |
| 7,356,852 | B2 | 4/2008 | Thai |
| D602,207 | S | 10/2009 | Hull |
| 2007/0048504 | A1 | 3/2007 | DiMario |
| 2007/0087674 | A1 | 4/2007 | Cox |
| 2008/0098501 | A1 | 5/2008 | Takata |
| 2009/0293175 | A1 | 12/2009 | Cox |

*Primary Examiner* — Danny Worrell

(74) *Attorney, Agent, or Firm* — Sand & Sebolt

(57) ABSTRACT

An ambidextrous glove that includes a thumb region, an index finger region, a middle finger region, a ring finger region and little finger region all aligned along a common axis. The index finger region is rotated through ninety degrees relative to the orientations of all of the middle, ring and little finger regions to provide for easier insertion of a hand into the glove. A textured pattern is provided on the surfaces of the glove used to grip objects. The pattern is one of a raised fan shape and raised diamond shape.

17 Claims, 5 Drawing Sheets

AMBIDEXTROUS GLOVE

CROSS-REFERENCE TO RELATED APPLICATIONS

This application is a continuation of U.S. patent application Ser. No. 12/421,785 filed Apr. 10, 2009, the entire specification of which is incorporated herein by reference.

BACKGROUND OF THE INVENTION

1. Technical Field

This invention generally relates to gloves. More particularly, the invention relates to a protective glove used in the food packaging and processing industry and more particularly the red meat and poultry processing industries. Specifically, the invention relates to an ambidextrous glove that may be used on either of the left hand and the right hand and which includes an index finger region rotated through ninety degrees relative to an axis along which the four finger regions of the glove are aligned.

2. Background Information

Gloves are used in the food processing and packaging industries to protect workers' hands from contamination and injury. Workers typically wear a liner that is a cotton knit material or is made from aramid fibers that protect against cuts and abrasions. A thicker, waterproof glove is worn over the liner to protect the worker. These gloves are typically manufactured from different polymers depending on the type of food processing applications they are to be used in. In the chicken processing industry, for instance, these exterior gloves are typically made from natural rubber latex. In the beef and pork processing industries the gloves are typically made from a variety of synthetic rubbers such as acrylonitrile-butadiene (nitrile), polychloroprene or polyvinyl chloride. The materials used for the gloves in the two industries differ because naturally occurring chemicals in chicken fat tend to attack materials other than natural rubber latex. This leads to a premature breakdown of the glove surface and the glove starts to swell. Once this occurs, the glove has to be thrown away. Since the gloves come in pairs, workers typically have to discard both gloves when only one of them has been damaged. In even a small food processing and packaging plant as many as a container load of undamaged gloves need to be disposed of each year. This tends to drive up the cost of doing business.

There is therefore a need in the industry for an improved glove that will assist in reducing the number of gloves that have to be purchased and discarded.

SUMMARY OF THE INVENTION

The device of the present invention is an ambidextrous glove that is specially designed to be worn on either of a left and a right hand.

The glove includes a thumb region, an index finger region, a middle finger region, a ring finger region and little finger region all aligned along a common axis. The index finger region is rotated through ninety degrees relative to the orientations of all of the middle, ring and little finger regions to provide for easier insertion of a hand into the glove. A textured pattern is provided on the surfaces of the glove used to grip objects. In order to distinguish between the gloves used in poultry processing facilities and beef or pork processing facilities, the gloves are provided with a raised, textured pattern on the surfaces used to grip objects. The pattern is one of a raised fan-shape for poultry processing gloves and a raised diamond-shape for beef or pork processing. The pattern is raised in texture to aid in gripping and safe handling of the meat product.

The glove preferably is of a unitary construction. The material used to manufacture the gloves preferably is of a progressive thickness with the material in the fingers of the glove being the thickest part of the glove.

BRIEF DESCRIPTION OF THE DRAWINGS

The preferred embodiments of the invention, illustrative of the best mode in which applicant has contemplated applying the principles, are set forth in the following description and are shown in the drawings and are particularly and distinctly pointed out and set forth in the appended claims.

DETAILED DESCRIPTION OF THE INVENTION

Figure 1:
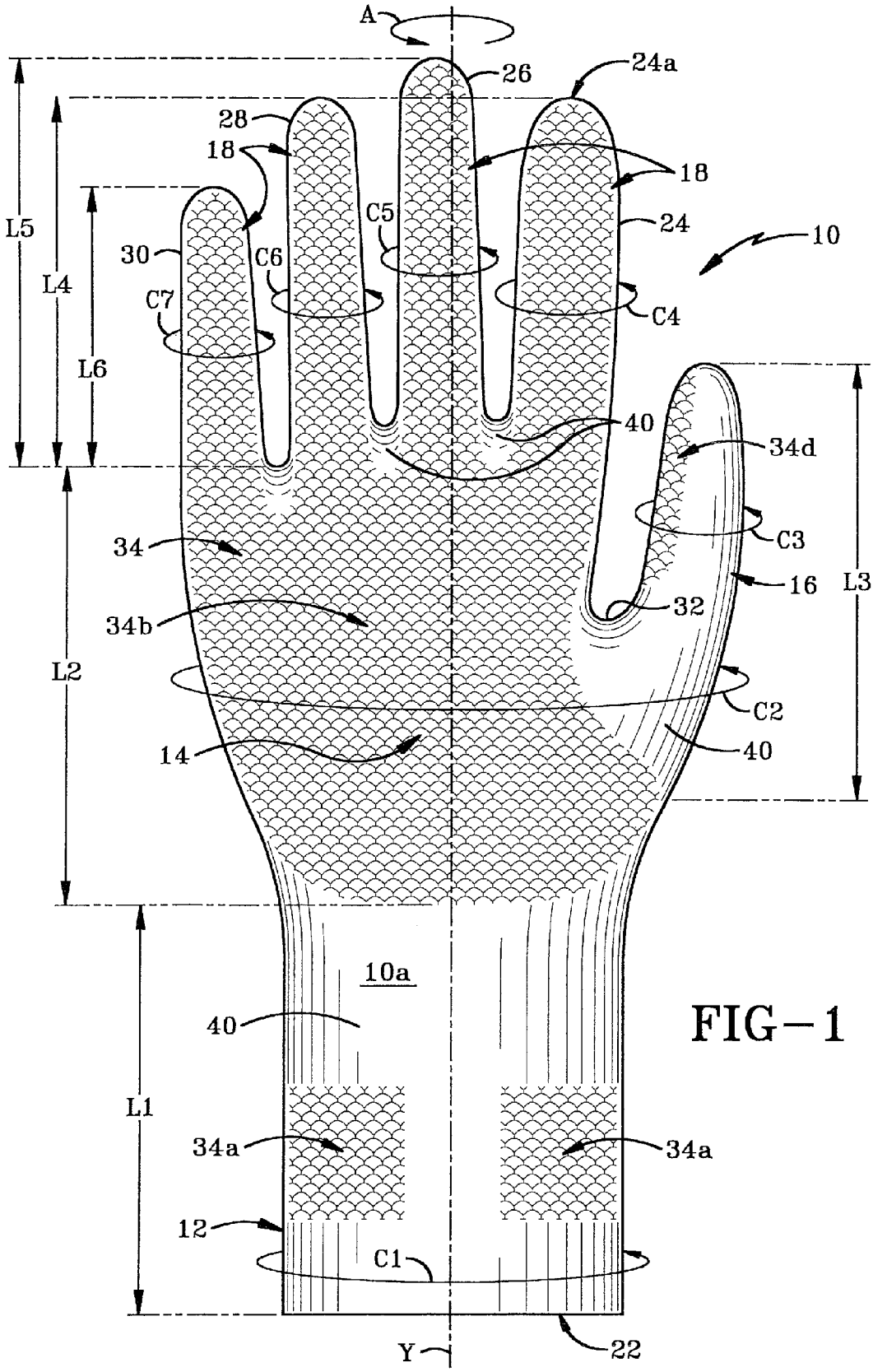
FIG. 1 is a front view of an ambidextrous glove in accordance with the present invention.
Figure 2:
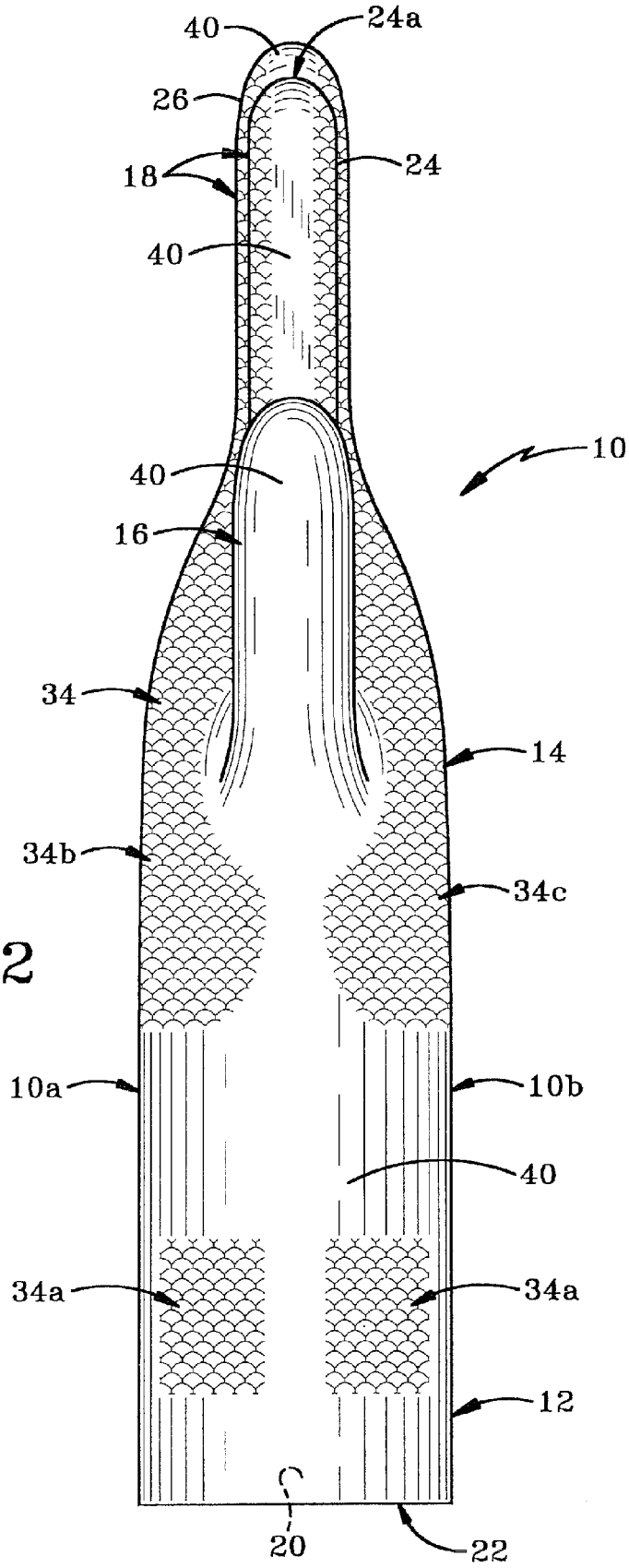
FIG. 2 is a right side view of the glove of FIG. 1.
Figure 3:
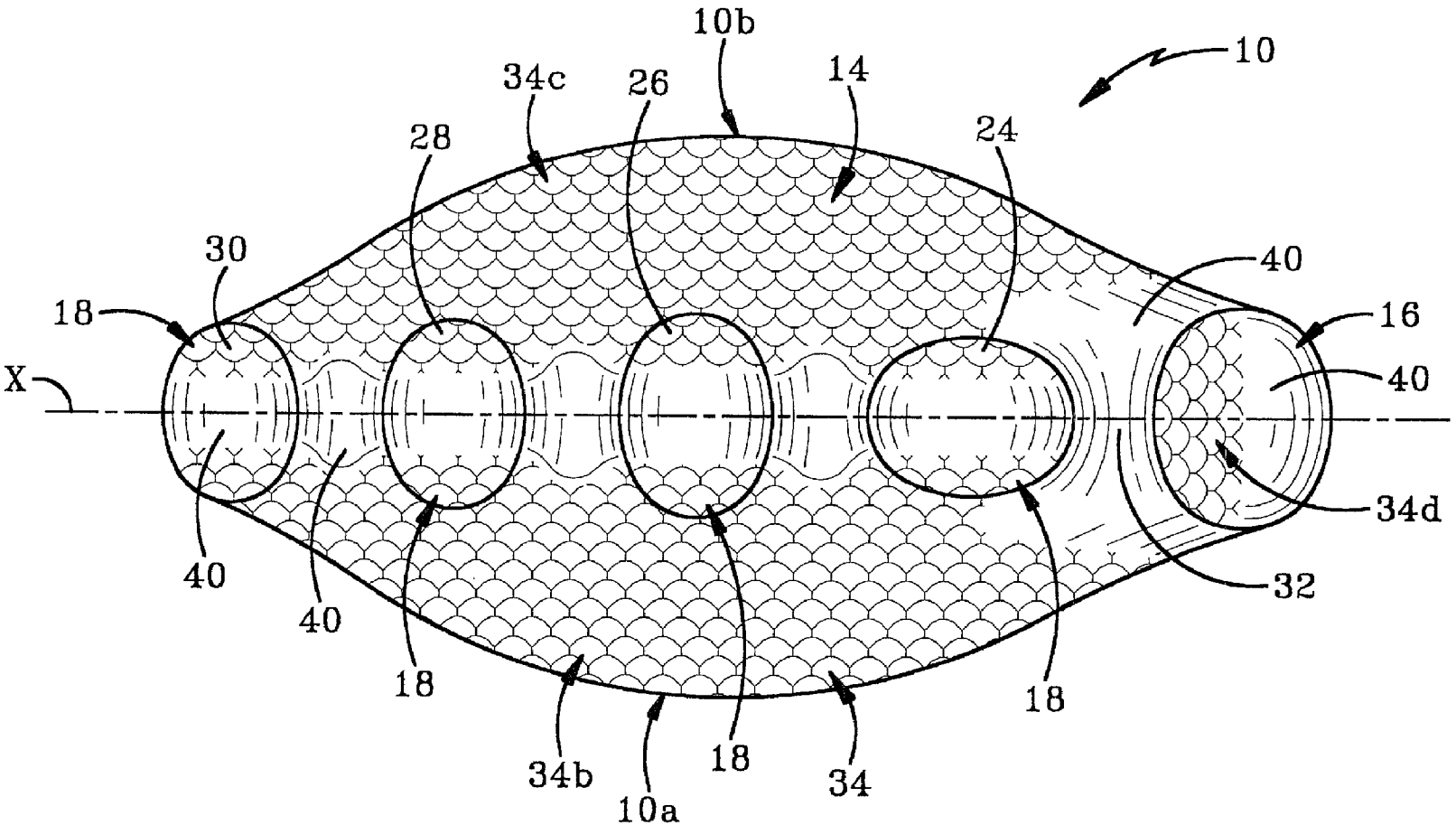
FIG. 3 is a top view of the glove of FIG. 1.
Figure 4:
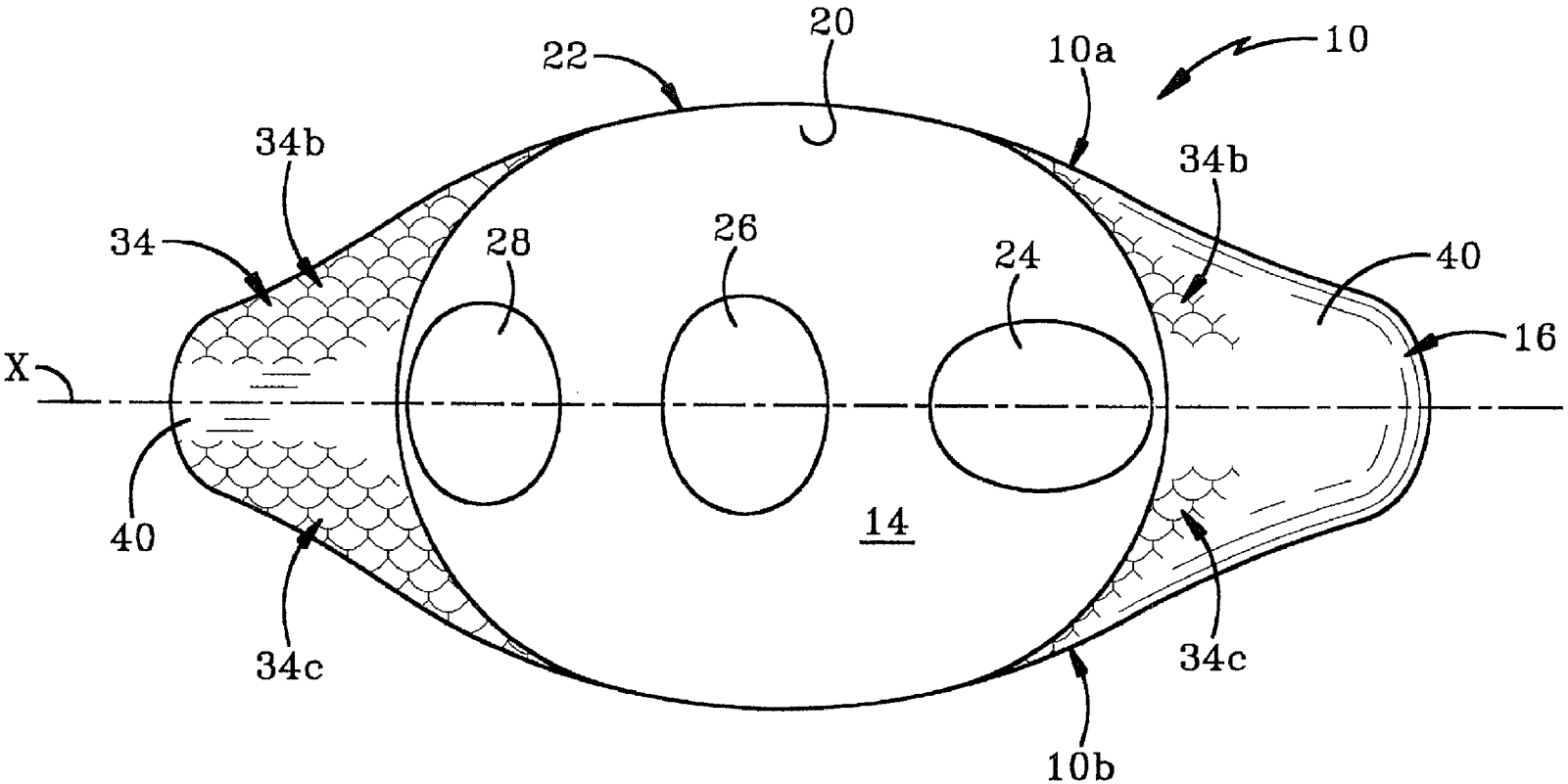
FIG. 4 is a bottom view of the glove of FIG. 1 showing the opening to the glove with the entryways into the index finger region, the middle finger region and the ring finger region being visible together with a portion of the palm region that is disposed between these finger regions.
Figure 5:
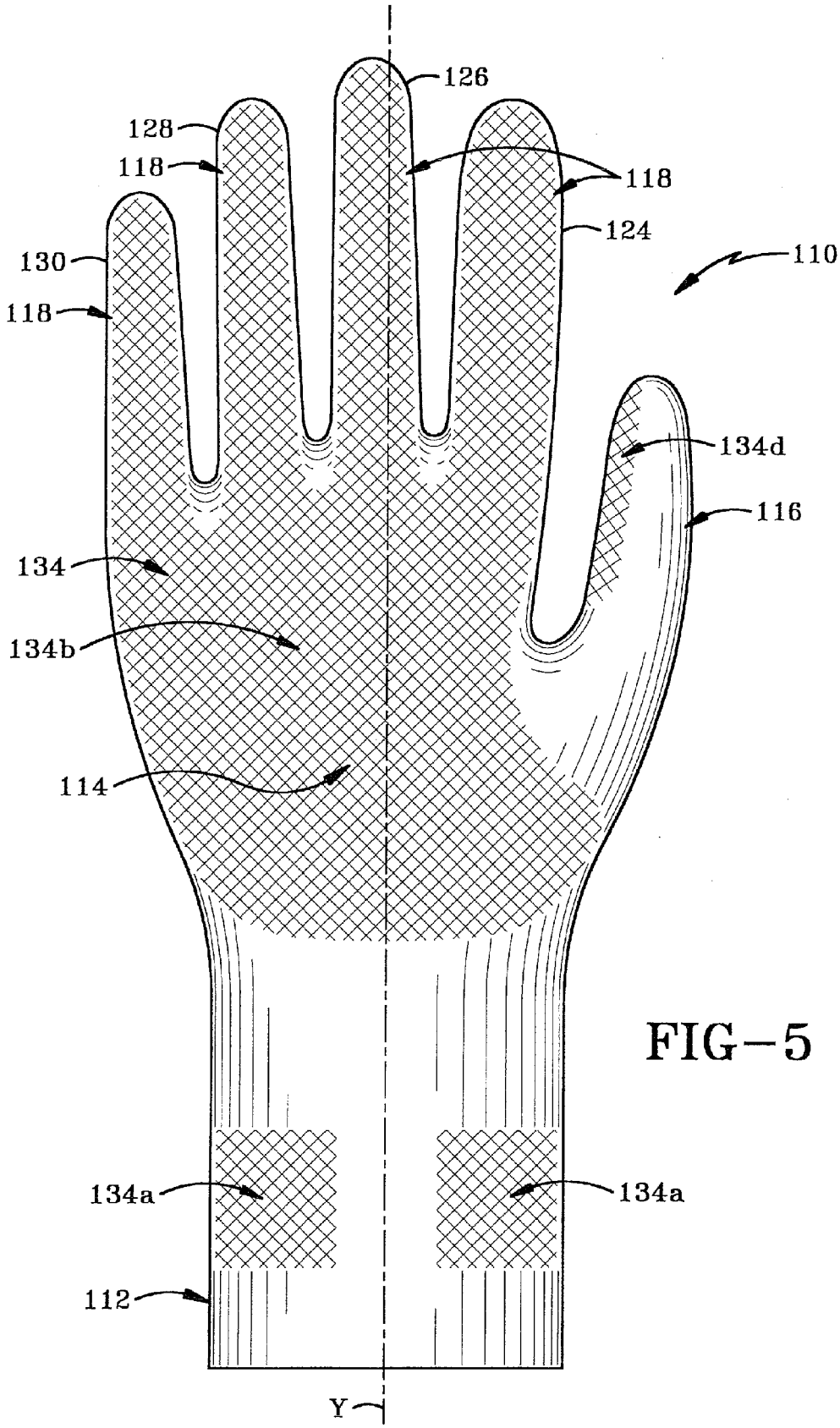
FIG. 5 is a front view of an ambidextrous glove in accordance with the present invention and showing an alternative embodiment of a texture pattern provided thereon.

Referring to FIGS. 1-5, there is shown a first embodiment of an ambidextrous or reversible glove in accordance with the present invention and being generally indicated at 10. Glove 10 is designed for use in the chicken processing industry and is provided with a fan-shaped gripping pattern on its exterior surface, as will be hereinafter described. A second embodiment of an ambidextrous glove in accordance with the present invention is shown in FIG. 5 and is generally indicated at 110. Glove 110 is designed for use in the beef and pork processing industries and is provided with a raised diamond-shaped gripping pattern on its exterior surface, as will be hereinafter described. Gloves 10 and 110 are designed to be worn on either of a left hand or a right hand. Both of FIGS. 1 and 4 illustrate the glove oriented for placement on a person's left hand. The glove is oriented for placement on a person's right hand by simply turning the glove through 180 degrees about a longitudinal axis "Y". This rotation is illustrated by the arrow "A" in FIG. 1.

Referring to FIGS. 1-4, glove 10 preferably is designed for use in the food processing and packaging industries and is therefore manufactured from any material suitable for use in these industries. Specifically as illustrated in FIG. 1, glove 10 is designed for use in the chicken processing and packaging industries. Glove 10 preferably is therefore manufactured from natural rubber latex or any other suitable material that will tend to not become damaged when exposed to chicken fat. Suitable materials preferably are also of a type that may be shaped on a mold as opposed to materials that must be sewn or otherwise secured together.

Glove 10 includes a wrist region 12, a palm region 14, a thumb region 16 and four digit regions 18. Glove 10 has a front exterior surface 10*a* and a back exterior surface 10*b*. The configuration of the glove 10 is such that the front and back surfaces 10*a*, 10*b* are substantially identical in appearance. It should be noted that the terms "front" and "back" are simply used herein in order to reference the specific orientation of glove 10 shown in the attached figures. Obviously, if the glove 10 is rotated through 180 degrees, the front surface 10*a* will become the back surface 10*b* and vice versa. Glove 10 preferably is manufactured as a unitary component and is therefore free of seams or other connection means between the various regions.

Wrist region 12 is configured to cover the wrist (not shown) of a person and preferably a portion of their lower forearm. An opening 20 (FIG. 4) is defined at the end 22 of wrist region 12. Opening 20 is sized so as to permit insertion of a hand therethrough. Wrist region 12 has a circumference C1 and a length L1. The end 22 of wrist region 12 is substantially planar and of a uniform thickness with the rest of wrist region 12. It should be noted that wrist region 12 preferably is free of any longitudinally aligned slits that might extend from the end 22 inwardly toward the digit regions 18 and which aid in inserting a hand into glove 10. First region 12 preferably is also free of any cuffs and any fastening mechanisms that might be used to secure glove 10 around the wrist or forearm of the wearer.

Palm region 14 extends outwardly away from the innermost end of wrist region 12 opposite end 22. Palm region 14 is configured to cover the front and back of the person's hand and has a circumference C2 and a length L2. The length L2 is measured from the innermost end of wrist region 12 up to the origin zones of the four digit regions 18.

Thumb region 16 extends outwardly from palm region 14 and has a circumference C3 and a length L3. Thumb region 16 is adapted to receive a thumb therein.

The four digit regions 18 extend outwardly from palm region 14. The four digit regions 18 and thumb region 16 are substantially aligned along a common axis "X" (FIG. 3) and are therefore substantially coplanar. The four digit regions 18 include an index finger region 24, a middle finger region 26, a ring finger region 28 and a little finger region 30 that are adapted to receive an index, middle, ring, and little finger, respectively. Thumb region 16 and index finger region 24 are separated from each other by a crotch 32 that is configured to permit the thumb region 16 to move easily relative to the palm region 14 and digit regions 8.

Index finger region 24 has a circumference C4 and a length L4. Middle finger region 26 has a circumference C5 and a length L5. Ring finger region 28 has a circumference C6. Ring finger region 28 is also of a length L4 that is substantially equal to the length of index finger region 24. It will be understood, however that index and ring finger regions 24, 28 may be manufactured to be of different lengths relative to each other. Finally, little finger region 30 has a circumference C7 and a length L6.

Referring to FIG. 3 and in accordance with one of the specific features of the present invention, all of digit regions 18 and thumb region 16 are aligned along an axis "X". This alignment aids in permitting glove 10 to be worn on either of a left and right hand. Furthermore, index finger region 24 is turned or rotated through 90 degrees relative to axis "X" as compared with middle, ring and little finger regions 26, 28, 30 and with thumb region 16. This orientation of index finger region 24 provides a wider and larger contact work surface area on index finger region 24. This gives gloves 10 a better gripping action as the primary gripping areas on index finger region 24 and thumb region 16 are enlarged relative to previously known gloves. The orientation of index finger region 24 also makes it easier for a user to insert their hand into the ambidextrous glove 10. The industry standard used prior to this invention is for all of the digit regions to be oriented in substantially an identical manner relative to an axis passing through these regions, such as axis "X".

As will be known to those skilled in the art, there are a variety of voluntary consensus standards laid out for various industries, including those involved in the manufacture of gloves. These voluntary standards are published by organizations such as ASTM International, the American National Standards Institute (ANSI), and the International Organization for Standardization (ISO). The standards are readily available to those skilled in the art and include standards for gloves manufactured on forms or molds. Gloves typically are manufactured in standard sizes 7, 8, 9, 10 and 11 or SS, S, M, L and XL. Each of these standard sizes has specific dimensions for the width, length and/or circumference of the various components on the form and thereby on the glove. Additionally, these components are arranged and oriented relative to each other in a particular manner. An example of the dimensions of a standard form is provided hereto as Appendix "A". In the following description, reference will be made to the "industry standard" for a variety of components. It should be understood by the reader that the inventor regards the "industry standard" as prior art. It should further be understood that the industry standard glove referred to herein is not an ambidextrous or reversible glove. It is a glove that is designed to be worn on only one of a left and a right hand. The table in Appendix "A" is provided by way of example only.

In accordance with one of the specific features of the present invention, the circumference C1 of wrist region 12 on glove 10 has been increased by between 5 mm and 10 mm over the circumference of the industry standard for the wrist region 12. For example, in an industry standard size 7 glove, the circumference of the wrist region is 166 mm while on glove 10 of the present invention the circumference is 192 mm. This increase in wrist region circumference C1 over the industry standard makes it easier for the person to put the glove 10 on either of their left and right hands.

Circumference C2 of palm region 14 has been increased by around 6 mm over the industry standard so that the glove 10 is easier to wear on either of a left and right hand, and also to permit the person to wear a liner (not shown) under glove 10. The industry standard for the circumference of a palm region on a size 10 glove, for example, is 235 mm, while the circumference C2 of the glove 10 in accordance with the present invention is 271 mm.

In accordance with yet another specific feature of the present invention, the circumferences C4 and C5 of index finger region 24 and middle finger region 26, respectively, are increased relative to the industry standard circumference for these components. For an industry standard size 7 glove, for example, the circumference of an index finger region would be 55 mm and the circumference of a middle finger region would be 59 mm. In the glove 10 of the present invention, however, the circumference C4 of index finger region 24 is 65 mm and the circumference C5 of middle finger region 26 is 74 mm. For an industry standard size 9 glove, the circumference of an index finger region would be 65 mm and the circumference of a middle finger region would be 69 mm. In the glove 10 of the present invention, however, the circumference C4 of index finger region 24 is 77 mm and the circumference C5 of middle finger region 26 is 82 mm. In the glove 10 of the present invention, the circumferences C4, C5 of index finger region 24 and middle finger region have each been increased by around 1 mm-5 mm and preferably by 2 mm-3 mm over the dimensions of the industry standard. The circumferences C6 and C7 of the ring and little finger regions 28, 30 on glove 10 remain the same as those used as the industry standard. The different orientation of index finger region 24 relative to the middle, ring and little finger regions 26, 28, 30, combined with the increased circumferences C4, C5 of index and middle finger regions 24, 26, makes it possible for a person to more easily insert either of their left and right hands into glove 10. These features also make it easier to wear and use the glove on either of a left and right hand as they aid in improving the fit of the glove on both hand orientations.

In accordance with yet another specific feature of the present invention, crotch 32 of glove 10 also differs from the industry standard in that the crotch 32 is situated about 7.2% further from the tip 24*a* of index finger region 24 than is the case in the industry standard. In the industry standard size 9 glove, the crotch is situated at a distance of 121 mm below the tip of the index finger region. In the glove 10 of the present invention, crotch 32 is situated at a distance of 130 mm below the tip 24*a* of index finger region 24. In an industry standard size 10 glove, the crotch is situated at a distance of 125 mm below the tip of the index finger region. In the glove 10 of the present invention, crotch 32 is situated at a distance of 132 mm below the tip 24*a* of the index finger region 24. Consequently, crotch 32 is positioned around 4-7 mm, and preferably 5 mm, lower than the crotch of the industry standard. This lower crotch position improves the fit of glove 10 when worn on either of a left or a right hand.

In accordance with a further specific feature of the present invention, glove 10 is provided with a gripping surface 34 on both of front and back surfaces 10*a*, 10*b* of glove 10. This gripping surface 34 takes the form of a textured pattern that is either embossed or molded into surfaces 10*a*, 10*b* or is applied externally thereto. Gripping surface 34 aids the person in gripping objects, especially wet or moist objects. FIG. 1 shows a first embodiment of a textured pattern used on gripping surface 34 of glove 10. This pattern preferably is a raised fan-shape pattern 34 that is provided in several zones on glove 10. The first of these zones is applied in an annular band 34*a* disposed proximate the end 22 of glove 10. Band 34*a* is substantially concentric with opening 20 and is provided to aid the worker in pulling gloves 10 on or off their hand. Band 34*a* may take the form of a substantially continuous annular band that circumscribes opening 20 or may, alternatively, and as is shown in the attached figures, take the form of a plurality of discrete regions of pattern that circumscribe wrist region 12. The second of these patterned zones 34*b* is provided on front exterior surface 10*a* of glove 10 and extends over substantially all of the palm region 14 all of the front surfaces of the index, middle, ring and little finger regions 24, 26, 28, 30 that may come into contact with an object when gripped. Patterned zone 34*b* preferably covers between 70% and 100% of palm region 14 and between 60% and 100% of digit regions 18. For instance, in the index finger region 24, the patterned zone 34*b* covers, on average 28%, more of the work surface than is the case in the industry standard.

In accordance with a specific feature of the present invention, a substantially identical third patterned zone 34*c* is provided on the rear exterior surface 10*b* of glove 10. Patterned zone 34*c* extends over substantially all of the palm region and the back surfaces of the index, middle, ring and little finger regions 24-30 that would come into contact with an object if the glove 10 were rotated through 180 degrees. Consequently, patterned zone 34*c* covers between 70% and 100% of palm region 14 and between 60% and 100% of digit regions 18. Because the front and back exterior surfaces 10*a*, 10*b* of the glove 10 are substantially identical to each other, the second and third patterned zones 34*b*, 34*c* are located in substantially identical positions on the front and back surfaces. The substantially identical location of the zones 34*b*, 34*c* on the front and back exterior surfaces of glove 10 are provided so that no matter which of the left and right hand the glove is worn on, the person has substantially the same ability to grip the object they need to hold.

It should be noted that there are areas 40 of wrist region 12, palm region 14, thumb region 16 and digit regions 18 that do not necessarily need to be provided with the textured pattern as these areas are not located in areas that will touch an object when the person is gripping the same using the glove. The surface of glove 10 in areas 40 preferably is substantially smooth. Nonetheless, if desired, these areas 40 may also be provided with the pattern 34 embossed thereon.

A fourth textured surface pattern 34*d* is provided on the interior side 42 of thumb region 16. This pattern is provided on substantially the entire side 42 to aid the person in gripping objects. The remainder of the thumb region 16 and the crotch 32 comprises one of the un-textured areas 40. The fourth textured surface pattern 34*d* is provided on between 30% and 50% of the thumb region 16, which substantially 100% of the pattern 34*d* being provided on the interior side surface 42.

All of the first, second, third and fourth patterned zones preferably are provided with a fan-shaped pattern. This pattern aids in channeling moisture away from the surface of the glove that directly contacts the object being gripped and thereby reduces the tendency of the object to slip out of the person's hands. The textured surface also bites slightly into the exterior surface of the object being held, thereby physically aiding in gripping of the same. It will be understood that patterns other than the fan shape may be utilized in these zones. However, the provision of the fan-shaped pattern on glove 10 acts a visual aid to workers so that they can be sure they are wearing a glove manufactured especially for handling poultry. The fan pattern provided on all the digit regions of glove 10 covers a larger area and provides a larger gripping work surface than any previously known hand specific glove, i.e., any previously known non-ambidextrous glove.

Referring to FIG. 5, there is shown a second embodiment of an ambidextrous glove in accordance with the present invention and generally indicated at 110. Glove 110 is designed for use in the beef and pork processing and packaging industries and is therefore typically manufactured from a variety of synthetic rubbers such as acrylonitrile-butadiene (nitrile), polychloroprene or polyvinyl chloride. It will be understood, however, that any other material suitable for this purpose may be utilized. Glove 110 is substantially identical in configuration to glove 10 in that it includes a wrist region 112, a palm region 114, a thumb region 116 and four digit regions 118. Digit regions 118 include an index finger region 124, middle finger region 126, ring finger region 128 and little finger region 130. The only difference between glove 10 and glove 110 is that the latter is provided with a raised diamond-shaped pattern in the gripping zones 134*a*, 134*b* and 134*d* instead of the fan-shaped pattern provided on glove 10. (As with glove 10, the back surface of glove 110, which is not illustrated herein, is provided with a substantially identical patterned zone to that of 134*b*). The raised diamond-shaped pattern provided in the zones 134 serves exactly the same function as that of the pattern in the zones 34 of glove 10. Consequently, the raised diamond-shaped pattern aids the worker in gripping objects and channels any moisture away from the surfaces of glove 110 that directly contact the object being held.

The gloves 10, 110 of the present invention are used by orienting them in the appropriate manner so that they may be pulled onto either of a right hand or a left hand. A food processing and packaging plant need only provide boxes of the ambidextrous gloves in the various sizes for their workers to use. If a glove becomes damaged or punctured during use, the worker can simply pull that single glove off their hand and dispose of the same. The undamaged glove on their other hand does not need to be removed and thrown away. The worker then selects a single ambidextrous replacement glove from the appropriate container and puts it on the exposed hand. In this way, the ambidextrous glove in accordance with the present invention tends to reduce the quantity of gloves used by a processing facility.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention are an example and the invention is not limited to the exact details shown or described.

APPENDIX A

HAND FORMER SPECIFICATION-MD-6 (SHARP FINGER)
(All dimensions are in mm)

| Description/Size | SS | S | M | L | XL |
|---|---|---|---|---|---|
| Height of Hand | 400 | 400 | 400 | 400 | 400 |
| Length of Hand | 181 | 193 | 198 | 217 | 220 |
| Palm Circumference | 168 | 177 | 200 | 228 | 235 |
| Wrist Circumference | 151 | 166 | 180 | 193 | 204 |
| Shank Circumference | 181 | 199 | 208 | 209 | 220 |
| Thumb length (1) | 49 | 53 | 55 | 58 | 63 |
| Index finger length (2) | 64 | 67 | 72 | 73 | 75 |
| Middle finger length (3) | 76 | 79 | 83 | 84 | 85 |
| Ring finger length (4) | 67 | 71 | 75 | 75 | 79 |
| Little finger length (5) | 47 | 54 | 56 | 59 | 62 |
| Thumb Circumference (1) | 57 | 60 | 65 | 73 | 80 |
| Index finger circumference (2) | 51 | 55 | 61 | 65 | 69 |
| Middle finger circumference (3) | 54 | 59 | 64 | 69 | 73 |
| Ring finger circumference (4) | 51 | 54 | 59 | 64 | 68 |
| Little finger circumference (5) | 44 | 47 | 52 | 57 | 61 |

The invention claimed is:

1. A glove comprising:

a palm region adapted to cover a palm and back of a person's hand;

a thumb region extending outwardly from the palm region and adapted to receive the person's thumb therein; and four digit regions extending outwardly from the palm region and adapted to receive the four fingers of the person's hand therein; and wherein said digit and thumb regions are substantially aligned with each other along a common axis; and wherein the glove is adapted to be an ambidextrous glove that is wearable on either of the person's left hand or right hand; and wherein said digit regions include:

an index finger region disposed adjacent the thumb region and adapted to receive the index finger of the person's hand therein; and wherein said index finger region is oriented at ninety degrees relative to the axis and to an orientation of the remaining three digit regions.

2. The glove as defined in claim 1, wherein the remaining three digit regions includes a middle finger region adjacent the index finger region and adapted to receive a middle finger therein; and wherein said middle finger region is wider than remaining two digit regions.

3. The glove as defined in claim 1, wherein the palm region, thumb region and digit regions are all manufactured from a material suitable for handling one of beef, pork and poultry.

4. The glove as defined in claim 1, wherein the palm region, thumb region and digit regions are provided with a textured pattern on an exterior surface thereof, and wherein the textured pattern is provided on between 70% and 100% of an exterior surface of said palm region.

5. The glove as defined in claim 4, wherein the textured pattern is provided on between 60% and 100% of an exterior surface of each of the digit regions.

6. The glove as defined in claim 5, wherein digit regions include an index finger region adapted to receive an index finger therein; and the thumb region includes an interior side surface disposed adjacent the index finger region; and wherein the textured pattern is provided on between 30% and 50% of the thumb region.

7. The glove as defined in claim 5, wherein substantially 100% of the textured pattern on the thumb region is provided on the interior side surface thereof.

8. The glove as defined in claim 4, wherein said textured pattern comprises a gripping surface formed from one of a plurality of raised fan-shaped areas and diamond-shaped areas disposed in abutting contact with each other and embossed on an exterior surface one or more of the palm region, digit regions and thumb region.

9. The glove as defined in claim 8, wherein said palm region, thumb region and digit regions are molded from natural rubber latex.

10. The glove as defined in claim 4, wherein said textured pattern comprises a gripping surface formed from a plurality of raised diamond-shaped areas disposed in abutting contact with each other and embossed on an exterior surface one or more of the palm region, digit regions and thumb region.

11. The glove as defined in claim 10, wherein said palm region, thumb region and digit regions are molded from a synthetic rubber consisting of one of acrylonitrile-butadiene, polychloroprene or polyvinyl chloride.

12. The glove as defined in claim 1, wherein the digit regions include an index finger region adapted to receive an index finger therein; and wherein the index finger region has a circumference and the circumference of the index finger region of a size 7 glove is increased by 10 mm over the industry standard of 55 mm for a size 7 glove; and the circumference of the index finger region for a size 9 glove is increased by 12 mm over the industry standard of 65 mm for a size 9 glove.

13. The glove as defined in claim 1, wherein the digit regions include a middle finger region adapted to receive a middle finger therein; and wherein the middle finger region has a circumference and the circumference of the middle finger region for a size 7 glove is increased by 15 mm over the industry standard of 59 mm for a size 7 glove; and the circumference of the middle finger region for a size 9 glove is increased by 13 mm for a size 9 glove.

14. The glove as defined in claim 1, wherein the palm region has a circumference and the circumference of the palm region for a size 10 glove is increased by 36 over the industry standard of 235 mm for a size 10 glove.

15. The glove as defined in claim 1, wherein the digit regions includes an index finger region terminating in a tip a distance remote from the palm region; and wherein the index finger region is disposed adjacent the thumb region and is separated therefrom by a crotch; and wherein the crotch in a size 9 glove is located 9 mm further away from the tip of the index finger region than the industry standard of 121 mm away from the tip of the index finger region of a size 9 glove; and is located 7 mm further away from the tip of the index finger region in a size 10 glove than the industry standard of 125 mm in a size 10 glove.

16. The glove as defined in claim 1, wherein the glove is disposable.

17. The glove as defined in claim 1, wherein the palm region has a front exterior surface adapted to cover the palm of the hand and a back exterior surface adapted to cover the back of the hand; and wherein each of the front and back exterior surfaces is provided with a textured gripping pattern in substantially identical locations.

* * * * *